United States Patent [19]

Edgerley

[11] 4,435,820

[45] Mar. 6, 1984

[54] CHANNEL INDUCTION FURNACES

[75] Inventor: Christopher J. Edgerley, Northwich, England

[73] Assignee: The Electricity Council, London, England

[21] Appl. No.: 304,408

[22] Filed: Sep. 21, 1981

[30] Foreign Application Priority Data

Sep. 24, 1980 [GB] United Kingdom ..... 8030813

[51] Int. Cl.[3] ..... H05B 5/02

[52] U.S. Cl. ..... 373/161

[58] Field of Search ..... 373/161, 159, 160, 163

[56] References Cited

U.S. PATENT DOCUMENTS

| | | | |
|---|---|---|---|
| 1,532,090 | 3/1925 | Unger | 373/161 |
| 1,684,504 | 9/1928 | Northrup | 373/161 X |
| 3,595,979 | 7/1971 | Shearman . | |
| 4,021,602 | 5/1977 | Delassus | 373/161 |

FOREIGN PATENT DOCUMENTS

| | | |
|---|---|---|
| 745187 | of 1944 | Fed. Rep. of Germany . |
| 888732 | of 1953 | Fed. Rep. of Germany . |
| 1558079 | of 1970 | Fed. Rep. of Germany . |
| 18073 | of 1914 | United Kingdom . |

*Primary Examiner*—Roy N. Envall, Jr.

*Attorney, Agent, or Firm*—Beveridge, DeGrandi & Kline

[57] ABSTRACT

A channel induction furnace, particularly for melting aluminum has a pair of U-shaped channels extending downwardly from the bath. The channels have a radial width, measured outwardly from the axis of the core, which is several times the penetration depth in the molten metal for a current of the energizing frequency and the channel section is tapered so that the channel is wider near the core and narrower away from the core. The planes containing the axes of the channels are skewed about an axis of skewing normal to the axis of the core.

16 Claims, 4 Drawing Figures

CHANNEL INDUCTION FURNACES

BACKGROUND OF THE INVENTION

This invention relates to channel induction furnaces such as are used for melting metals.

The channels induction furnace of the present invention finds particular application for melting aluminum. Aluminum is a metal or low density and low resistivity and therefore requires high currents to be induced in the molten metal, in comparison with other metals of higher density and higher resistivity. High current in the metal results in the generation of high forces. In a channel furnace of conventional construction, if the power input to the furnace is increased beyond a certain value, the pinch effect due to the internal forces on the metal causes a break in the continuity of metal in the loop. This causes the electric current path around the loop to be broken; the electromagnetic forces than cease and the metal will flow under gravity to re-establish the current path. Such repetitive interruptions and restorations of the electrical power are obviously undesirable. This leads to the use of a larger bath or crucible in order to give a greater head of metal to prevent the electromagnetic forces causing the metal loop to break. For this reason, with present designs of such furnaces, there are limitations to the power which can be fed into a channel furnace of given size, i.e. for heating a given quantity of metal. There are many circumstances however in which it is desirable to have a high power density inductor for a compact channel furnace having only a low head. For example, this would enable small quantities of metal to be melted more efficiently.

It is known (see for example U.K. Patent Specification No. 506980) to make the radial depth of the channel greater than the penetration depth of the alternating current at the frequency used. It is one object of the present invention still further to improve the efficiency of such a furnace.

BRIEF SUMMARY OF THE INVENTION

According to the present invention, in a channel induction furnace having a bath for containing molten metal with a channel forming a loop extending downwardly from the bath, a ferromagnetic core forming a closed magnetic circuit linked with the channel and an alternating-current energized coil on the core, wherein the channel is shaped so as to extend in an arcuate path around the coil and core at least in the region below the plane of the axis of the core, the channel having a radial width, measured outwardly from the axis of the core, which is several times the penetration depth in the molten metal for a current of the energizing frequency and wherein the width of the channel measured parallel to the axis of the core is tapered in the region where the channel is below the plane of the axis of the core, the tapering being such that the channel is wider near the core and narrower away from the core. The tapering is preferably to not more than half the maximum width of the channel.

This tapering produces a flow system across the width of the channel and its main advantage is to enable the power density under maximum head to be maximized.

Alternatively but preferably additionally, the plane containing the axis of the channel where it extends arcuately around the core is a flat plane, which is skewed about an axis of skewing normal to the axis of the core and passing through the lowest point of the channel. The amount of skew is preferably small; it may be 20° or less and preferably is in the range of 5° to 10°.

The invention furthermore includes within its scope a channel induction furnace having a path for containing molten metal with a channel forming a loop extending downwardly from the bath, a ferromagnetic core forming a closed magnetic circuit linked with the channel and an alternating current enerized coil on the core, wherein the channel is shaped so as to extend in an arcuate path around the coil and core at least in the region below the plane of the axis of the core, the channel having a radial width, measured outwardly from the axis of the core, which is several times the penetration depth in the molten metal for a current of the energizing frequency and wherein the plane containing the axis of the channel where it extends arcuately around the core is a flat plane, which is skewed about an axis of skewing normal to the axis of the core and passing through the lowest point of the channel.

Preferably the channel is substantially in a vertical plane and the core is in a horizontal plane. A vertical plane for the channel ensures the maximum static head of metal.

The skewing of the channel with respect to the horizontal axis of the inductor provides unidirectional flow so that the metal flows down one arm of the U and up the other. Skewing is particularly beneficial in low head furnaces. The combination of the skew and the taper enables a high flow rate and high velocity to be obtained so minimizing oxide formation in the channel.

A furnace may have two such channels opening into the bottom of a common bath or crucible. Two such channels may be arranged on a common core and, in this case, preferably the core has two coils arranged respectively on parallel arms of the core which arms pass through the loops formed by the respective channels. A two-channel arrangement however may have separate cores for each of the channels to enable still higher power to be applied.

By making the width of the channel substantially greater than the penetration depth of the current, a non-uniform current distribution is obtained across the width of the channel. The induced current is higher nearer the coil and core and is lower on the outside. This non-uniform current causes flow patterns across the width of the coil. The tapering cross section results in the channel being narrowest at the lowest point and thereby causes the highest electromagnetic pressures at the bottom of the channel. This generates another flow pattern and the large width at the sides gives room for the metal to flow. As is well-known, there are various ways of causing unidirectional flow around a channel in a channel furnace. The preferred way in the present invention is by the use of the skewed channel as described above. It will be seen that the channel section has radial depth to generate a non-uniform current distribution permitting local circulation; this gives minimum interference with the major flow system introduced by the taper which provides an unbalanced electromagnetic pressure between the base of the loop and the bath and the skewing which provides a unidirectional flow. This unidirectional flow arises from the leakage field which is higher towards the inside of the core than towards the outside.

Preferably the channel has a substantially semi-circular arcuate form at least around the region where it passes below the axis of the core. Using a semi-circular arc centred on the axis of the core, the channel can be arranged as close as possible to the core so as to obtain the maximum effect.

It will be seen that, with the arrangement described above, the forces induced in the metal increase the flow of metal. This is of particular importance with aluminum melting where oxide formation can occur; the high velocity of flow helps to prevent oxide formation in the channel. It is possible however, in the known way, to inject gas into the channel to prevent or reduce oxide formation.

Thus the invention includes within its scope a channel induction furnace for melting aluminum and having a bath for containing molten metal with a channel forming a loop extending downwardly from the bath in a substantially vertical plane, a ferromagnetic core forming a closed magnetic circuit linked with the channel and with its axis substantially in a horizontal plane, a coil on the core arranged for energization from a low frequency (50 to 60 Hz) alternating power supply, the channel having an arcuate portion below the axis of the core extending in an arc around the underside of the coil on the core, the channel in this arcuate portion having a radial width of at least 100 mm in the radial direction outwardly from the axis of the core, and the channel, in this arcuate portion, having a width measured parallel to the axis of the core, which is wider nearer that axis and decreases away therefrom.

The channel is preferably of generally U shape with the plane of the U vertical but at an angle of from 5° to 10° to a vertical plane normal to the axis of the core where the core passes through the channel loop. As indicated above the said arcuate portion is preferably substantially semi-circular about a center on the axis of the loop.

DESCRIPTION OF THE PREFERRED EMBODIMENT

Figure 1:
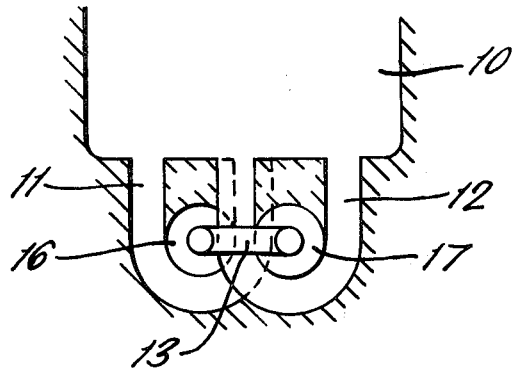
FIG. 1 is a diagrammatic side elevation of a channel induction furnace for melting aluminum.

The furnace shown in FIG. 1 is for the melting of aluminum using a 50 Hz power supply and employing a single core twin coil inductor. The furnace comprises a bath or crucible 10 for containing the molten metal with two U-shaped channels 11, 12 extending downwardly from the bottom of the bath to form two loops each of which extends around a coil on a ferromagnetic core 13.

Figure 2:
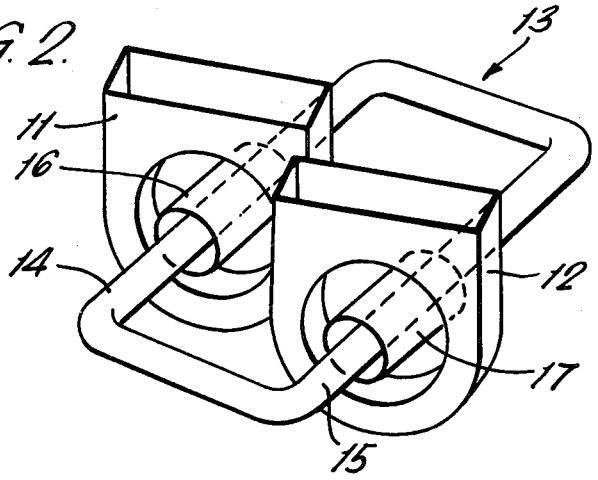
FIG. 2 is a perspective view showing diagrammatically two channels, two coils and a common core of the furnace of FIG. 1, the dimensions of the core being not to scale in order more clearly to illustrate the components.
Figure 3:
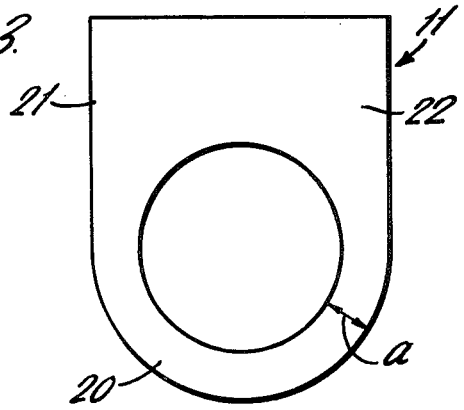
FIG. 3 is a diagram showing the shape of a channel in front elevation.
Figure 4:
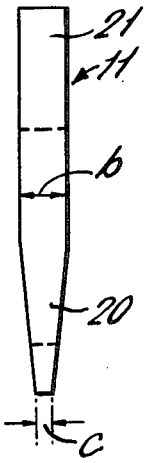
FIG. 4 is a diagram showing the shape of the channel in side elevation.

The coil and core arrangement is more clearly seen in FIG. 2. The core 13 is formed of laminated ferromagnetic material in the form of a closed loop, the axis of which lies in a horizontal flat plane. The loop is of substantially rectangular form and on two opposite parallel arms 14, 15 there are arranged respective coils 16, 17 which are energized from a 50 Hz supply. The two channels 11, 12 are shown diagrammatically in FIGS. 1 and 2. Each is a generally U-shaped channel open at the top into the bath or crucible 10, the channel being defined by walls of refractory material. Each channel lies in a substantially vertical plane. This plane however is skewed with respect to the normal to the axis of the core where the core passes through the loop formed by the channel. The angle of skew, that is to say the angle between the plane of the channel and a plane normal to the axis of the core, is, in this particular embodiment, about 7°. Each channel in the region below the axis of the core is in the form of a substantially semi-circular arc 20 centered on the axis of the core. Above the axis of the core, the two arms 21,22 of the channel extend upwardly into the base of the bath or crucible. The radial width (a) of the channel in the semi-circular region 20 is substantially constant and, in this particular embodiment, is about 120 mm. This is several times the penetration depth for a 50 Hz electric field in molten aluminum. This semi-circular shape is shown in FIG. 3. FIG. 4 shows the tapered section of the channel which, measured in a direction parallel to the axis of the core, has a width which is widest closest to the core (as shown at b) and tapers uniformly in the direction away from the core to a narrower width (c) at the bottom of the channel. The taper is to a width which is not more than 50% of the maximum width.

The skewing of the channel with respect to the horizontal axis of the inductor provides the unidirectional flow, that is to say the metal flows down one arm of the U and up the other. The taper provides an unbalanced electromagnetic pressure between the base of the loop and the bath. With the large radial width of the channel, greatly in excess of the penetration depth, there is a non-uniform current distribution; induced currents are concentrated nearer the coil and core and are much less on the outside. This gives a flow pattern resulting in flows across the width of the channel. The taper, providing a small cross section at the bottom, results in higher electromagnetic pressures at the bottom of the channel and this generates another flow pattern. With the large width at the sides adjacent the core, there is room for the metal to flow and the skew produces unidirectional flow, that is to say down one arm and up the other. This unidirectional flow is produced by the difference in the leakage field, the leakage field being higher in the arm inside the loop formed by the core than it is in the outer arm. It has been found that this construction enables substantial forces to be transferred into the flow system enabling a high power to be put into the inductor without causing any pinch effect resulting in breaking of the metal path along the channel. The high flow rate and high velocity prevents oxide formation in the channel.

The skewing of the channels with respect to the axis of the core is a preferred way of obtaining the required unidirectional flow pattern. As is well-known however unidirectional flow can be obtained, e.g. by shaping the throat of the channel in the region where it joins the bottom of the bath.

In the embodiment illustrated, the two channels form loops around two opposite arms of a single core. Separate cores could be provided for the two channels, enabling still higher power to be employed. In such an arrangement, the two cores might have a common center leg.

I claim:

1. A channel induction furnace having a bath for containing molten metal with a channel forming a loop extending downwardly from the bath, a ferromagnetic core forming a closed magnetic circuit linked with the channel and an alternating-current energized coil on the core, wherein the channel is shaped so as to extend in an arcuate path around the coil and core at least in the region below the plane of the axis of the core, the channel having a radial width, measured outwardly from the axis of the core, which is several times the penetration depth in the molten metal for a current of the energizing frequency and wherein the width of the channel measured parallel to the axis of the core is tapered in the region where the channel is below the plane of the axis of the core, the tapering being such that the channel is wider near the core and narrower away from the core.

2. A channel induction furnace as claimed in claim 1 wherein the tapering is such that the channel width tapers to not more than half its maximum width.

3. A channel induction furnace as claimed in claim 1 wherein the plane containing the axis of the channel where it extends arcuately around the core is a flat plane skewed about an axis of skewing normal to the axis of the core and passing through the lowest point of the channel.

4. A channel induction furnace as claimed in claim 3 wherein the angle is 20° or less.

5. A channel induction furnace as claimed in claim 3 wherein the angle of skew is in the range of 5° to 10°.

6. A channel induction furnace as claimed in claim 3 wherein the channel is in a vertical plane.

7. A channel induction furnace as claimed in claim 3 wherein the core is in a horizontal plane.

8. A channel induction furnace as claimed in claim 3 and having two channels opening into the bottom of a common bath.

9. A channel induction furnace as claimed in claim 8 wherein the two channels are arranged on a common core.

10. A channel induction furnace as claimed in claim 9 wherein the core has two coils arranged respectively on parallel arms of the core which arms pass through the loops formed by the respective channels.

11. A channel induction furnace as claimed in claim 8 wherein separate ferromagnetic cores are provided for each of the two channels.

12. A channel induction furnace as claimed in claim 1 wherein the channel has a substantially semi-circular arcuate form at least around the region where it passes below the axis of the core.

13. A channel induction furnace for melting aluminum and having a bath for containing molten metal with a channel forming a loop extending downwardly from the bath in a substantially vertical plane, a ferromagnetic core forming a closed magnetic circuit linked with the channel and with its axis substantially in a horizontal plane, a coil on the core arranged for energization from a low frequency (50 to 60 Hz) alternating power supply, the channel having an arcuate portion below the axis of the core extending in an arc around the underside of the coil on the core, the channel in this arcuate portion having a radial width of at least 100 mm in the radial direction outwardly from the axis of the core, and the channel, in this arcuate portion, having a width measured parallel to the axis of the core, which is wider nearer that axis and decreases away therefrom.

14. A channel induction furnace as claimed in claim 13 wherein said channel is of generally U-shape with the plane of the U vertical but at an angle of from 5° to 10° to a vertical plane normal to the axis of the core where the core passes through the channel loop.

15. A channel induction furnace as claimed in either claim 13 or claim 14 wherein said arcuate portion is substantially semi-circular about a center on the axis of the core.

16. A channel induction furnace as claimed in claim 13 wherein the plane containing the axis of the channel where it extends arcuately around the core is skewed about an axis normal to the axis of the core and passing through the lowest point of the channel, the angle of skewing being 20° or less.

* * * * *